United States Patent [19]

Leonard

[11] 4,162,964

[45] Jul. 31, 1979

[54] METHOD OF HANDLING ASH-RICH MATERIAL IN A COAL DEASHING PROCESS

[75] Inventor: Robert E. Leonard, Oklahoma City, Okla.

[73] Assignee: Kerr-McGee Corporation, Oklahoma City, Okla.

[21] Appl. No.: 887,869

[22] Filed: Mar. 20, 1978

[51] Int. Cl.[2] ..... B01D 3/06; C10G 1/04; B01D 11/04

[52] U.S. Cl. ..... 208/177; 210/22 R; 210/66; 210/73 R; 208/8 LE

[58] Field of Search ..... 210/66, 71, 73, 76, 210/83, 104, 112, 143, 21, 22; 159/2 R, 44; 203/86, 88, 39; 208/8, 177, 251 R; 34/19, 10; 196/133

[56] References Cited

U.S. PATENT DOCUMENTS

| | | | |
|---|---|---|---|
| 2,100,895 | 11/1937 | Austin | 196/133 |
| 2,325,573 | 7/1943 | Thompson et al. | 159/44 |
| 2,454,653 | 11/1948 | Kamp | 210/112 |
| 3,057,478 | 10/1962 | Price | 210/121 |
| 3,396,846 | 8/1968 | Hamilton | 210/83 |
| 3,954,595 | 5/1976 | Sze et al. | 208/8 |

OTHER PUBLICATIONS

Chemical Engineering Thermodynamics, J. M. Smith et al., McGraw-Hill Book Co., New York, Second Edition, 1959, p. 30.

*Primary Examiner*—Charles N. Hart
*Assistant Examiner*—David R. Sadowski
*Attorney, Agent, or Firm*—William G. Addison

[57] ABSTRACT

A process and apparatus for maintaining continuous operation of a coal deashing process during periods of normal operation wherein a dry, powdery ash concentrate composition is produced and during process upsets wherein undesired semi-solids or fluid compositions are produced.

4 Claims, 2 Drawing Figures

METHOD OF HANDLING ASH-RICH MATERIAL IN A COAL DEASHING PROCESS

CROSS-REFERENCE TO RELATED APPLICATIONS

This application relates to applicants copending application Ser. No. 838,021 entitled "A Powdery Composition Comprising Coal Products And System For Producing Same In A Coal Deashing Process" filed Sept. 29, 1977.

BACKGROUND OF THE INVENTION

1. Field of the Invention

This invention relates to a process and apparatus for handling a discharge of ash concentrate from a coal deashing system under a variety of operating conditions.

2. Description of the Prior Art

Various coal processing systems have been developed in the past wherein coal has been treated with one or more solvents and processed to separate the resulting insolubles from the soluble coal products.

An improved process for deashing coal liquefaction products is disclosed in U.S. patent application Ser. No. 838,021 filed Sept. 27, 1977 and assigned to the same assignee as the present invention. In said application, a feed mixture comprising soluble coal products, solvent and insoluble coal products is separated in a first separation zone maintained at an elevated temperature and pressure into a first heavy phase comprising insoluble coal products and some of the solvent and a first light phase. The insoluble coal products comprise the undissolved coal, mineral matter, other solid inorganic particulate matter and other such matter which is insoluble in the solvent solution under the operating conditions of the instant process.

The first heavy phase is withdrawn from the first separation zone and the pressure level is reduced at least 100 psig and preferably at least about 500 psig to vaporize the solvent and yield an ash concentrate composition in a dry, powdery form. The powdery ash concentrate composition can be made into aqueous slurries for use as a feed to subsequent processing equipment such as for example, gasifiers to recover additional hydrogen values or transported by mechanical means such as, for example, screw feeders or pneumatically.

Under certain conditions however, it has been found that the first heavy phase does not yield the desired, dry, powdery ash concentrate composition upon withdrawal and pressure reduction. Thus, sometimes the discharged first heavy phase is in the form of large chunks or deposits or a continuous extrusion of a semi-fluid which plugs the apparatus designed for handling a free flowing powder. Further, the deposits are hard to remove after formation in the transfer lines or vessels and require a tedious and expensive cleanout to restore operations.

Thus, it would be desirable to provide a means by which the first heavy phase can be handled when the first heavy phase does not form the dry, powdery composition.

SUMMARY OF THE INVENTION

The discovery now has been made that continuous operation of a coal deashing process can be maintained by providing two separate systems for handling the discharged first heavy phase. One system is designed to handle the normal dry, powdery composition and the other system is designed to handle semi-solid or liquid compositions. A means for detecting the latent properties of the first heavy phase so that it can be discharged to the appropriate system also is provided.

The feed mixture comprising soluble coal products, insoluble coal products and solvent is separated in a first separation zone maintained at selected conditions of elevated temperature and pressure to form a first heavy phase and a first light phase. When operating under the selected conditions the first heavy phase is withdrawn and discharged through a flash valve and yields the dry, powdery ash concentrate composition. During process start-up and shut-down, the first heavy phase will not form the dry, powdery composition upon flashing. At these times and at any other time when the first heavy phase does not form a dry, powdery composition upon flashing, the flow of the first heavy phase is transferred to alternative recovery apparatus.

The alternate recovery apparatus consists of process units equipped for batch removal of semi-solid or liquid masses. Alternatively, the flow of discharged first heavy phase can be introduced directly into a coking unit to recover additional hydrocarbon values or a furnace to recover its heating value.

DESCRIPTION OF THE PREFERRED EMBODIMENT

Figures 1, 2:
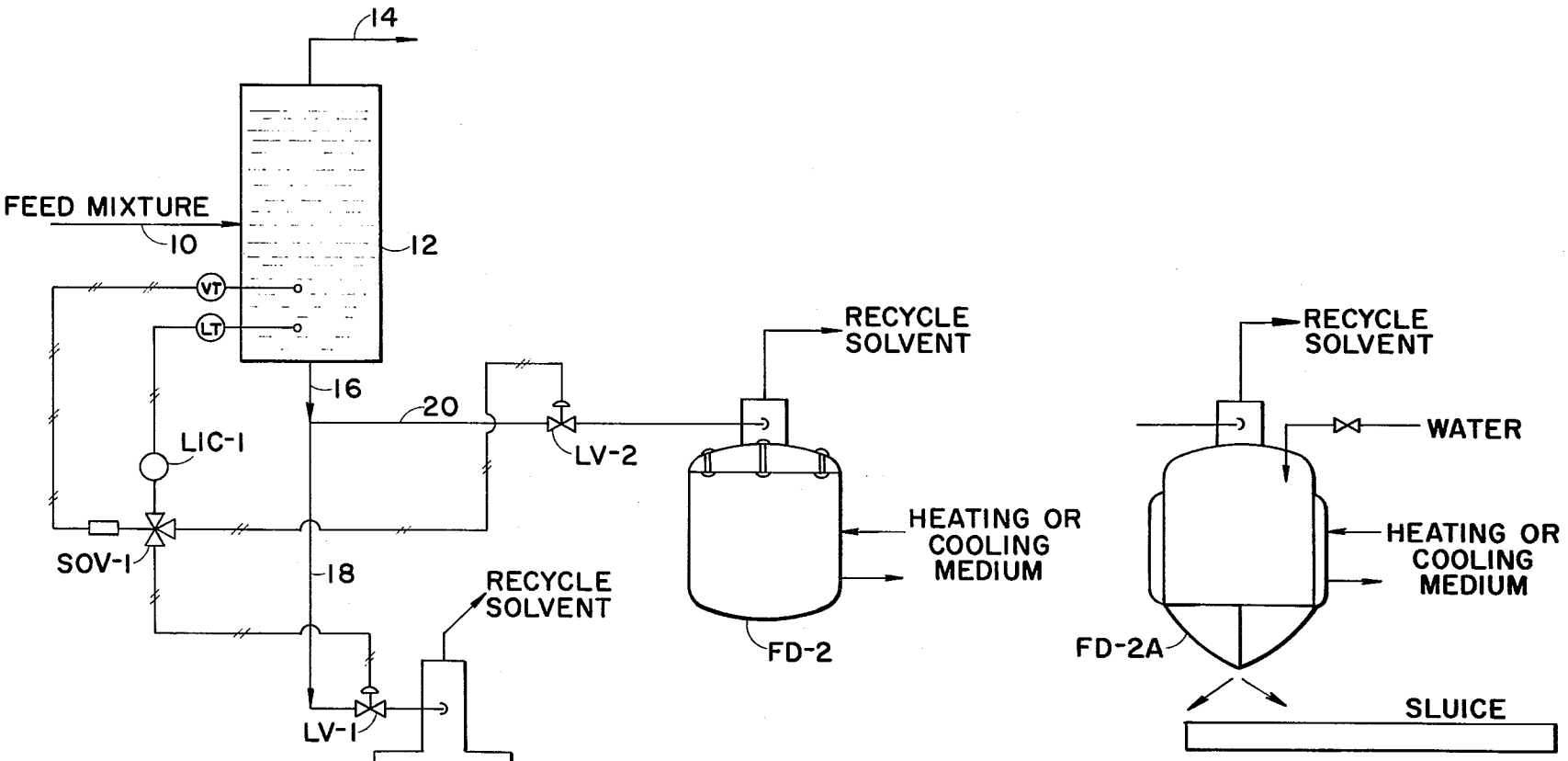
FIG. 1 is a schematic, diagrammatic illustration of apparatus arranged in accordance with the process of this invention.
FIG. 2 is a schematic, diagrammatic illustration of an alternate embodiment of the apparatus of this invention.

In the practice of the invention disclosed in U.S. patent application Ser. No. 838,021 filed Sept. 27, 1977 the disclosure of which is incorporated herein by reference, a feed mixture (comprising soluble coal products, insoluble coal products and solvent) is passed from a mixing zone through a conduit into a first separation zone maintained at an elevated temperature and pressure.

In the first separation zone, the feed mixture is separated into a first light phase comprising the soluble coal products and solvent and a first heavy phase comprising insoluble coal products and some solvent. The insoluble coal products comprise undissolved coal, mineral matter, other inorganic particulate matter and other such matter which is insoluble in the solvent solution under the operating conditions of the instant process. The solvent consists essentially of at least one substance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs.

The first light phase is withdrawn and passed into subsequent processing apparatus to effect a separation of the soluble coal products from the solvent. The first heavy fraction is withdrawn from the first separation zone and the pressure is reduced at least 100 psig and preferably at least 500 psig to yield the powdery, ash concentrate composition.

Turning now to FIG. 1, a feed mixture comprising soluble coal products, insoluble coal products and solvent enters a first separation zone 12 through a conduit 10. The temperature level in the first separation zone 12 is maintained in the range of from about 400 degrees F. to about 700 degrees F. and the pressure level is maintained in the range of from about 700 psig to about 1000 psig. Preferably, the first separation zone 12 is maintained at a temperature level in the range of from about 400 degrees F. to about 650 degrees F. and a pressure level in the range of from about 800 psig to about 950 psig.

Under such conditions, the feed mixture separates into a first light phase comprising soluble coal products and solvent and a first heavy phase comprising insoluble coal products and some solvent.

The first light phase is withdrawn from the first separation zone 12 through a conduit 14 to enter subsequent processing apparatus (not shown).

The first heavy phase is withdrawn from the first separation zone 12 through a conduit 16. The first heavy phase in conduit 16 may flow to a first flash drum separator FD-1 via a conduit 18 or to a second flash drum separator FD-2 via a conduit 20. The first flash drum separator FD-1 is specially designed to handle the first heavy phase when it is converted, upon pressure reduction, into a dry, powdery ash concentrate composition. The mechanism operatively associated with the first flash drum separator FD-1 is not designed to handle the material if it is in a semifluid condition or a partially powder-fluid mixture. A method, to be described hereinafter, has been designed to provide a means for disposing of the first heavy phase, in an alternate system, when it is in a semi-fluid or powder-fluid state.

During periods of normal operations, a level indicator controller LIC-1 actuates a level valve LV-1 to maintain a constant interface level within the separation zone 12. The viscosity of the heavy phase within separation zone 12 is measured by a viscosity transmitter VT-1. This viscosity is compared to a reference viscosity known to be indicative of normal operation. A low value for the viscosity of the heavy phase in separation zone 12 indicates that when the first heavy phase is discharged from separation zone 12 it will not yield a powdery composition. When this condition occurs, the viscosity transmitter VT-1 transmits a signal to a control valve SOV-1 which transfers the signal from LIC-1 to LV-1 to a second level valve LV-2. Fluid properties other than viscosity also can be used to transfer the flow from the first flash drum separator FD-1 to the second flash drum separator FD-2. Level valves LV-1 and LV-2 also can be operated manually.

In first flash drum separator FD-1 the first heavy phase is reduced in pressure at least 100 psig and preferably at least about 500 psig to yield the dry, powdery ash concentrate composition. The solvent which is separated from the ash concentrate within the first flash drum separator FD-1 is withdrawn and recycled in the process.

If the viscosity measured in separation zone 12 indicates that the powdery composition will not be formed, control valve SOV-1 is actuated to place level valve LV-2 in service instead of level valve LV-1. Level valve LV-2's activation allows the first heavy phase to enter a second flash drum separator FD-2 especially designed to handle the first heavy phase material when in a semi-fluid condition or a partially powder-fluid condition.

The control system previously described provides a means by which it is possible to maintain continuous operation when discharging the dry powdery ash concentrate composition produced under proper operation of the described coal deashing process and the semi-solids or fluids which can result from many forms of misoperation or during start-up and shut-down of the process apparatus.

The second flash drum separator FD-2 is an especially designed process unit. The process unit can be heated or cooled as required by the conditions of the process. In one embodiment, the second flash drum separator FD-2 is an enclosed vessel having a readily removable inner liner. The first heavy phase discharged into the second flash drum separator FD-2 is separated into a solids containing stream and an overhead stream containing any solvent or other hydrocarbonaceous material that is capable of volatilization upon pressure reduction within the flash separator. When the inner liner within the second flash drum separator FD-2 is full, the vessel can be quickly opened, the full liner removed and a new empty liner inserted therein.

Turning now to FIG. 2, in an alternate embodiment, the second flash drum separator FD-2A is provided with quick opening devices such that the lower portion of the separator can be opened to allow the contents to be dumped or sluiced into a suitable container or other conveyance. This separator also is provided with heating and cooling means as well as a water source to aid in the sluicing operation.

For the purpose of illustrating the present invention, and not by way of limitation, feed mixtures are prepared by mixing coal liquefaction products with a solvent comprising benzene in a ratio of about one part by weight of coal liquefaction products to about five parts by weight of benzene at a pressure level in the range of from about 700 psig to about 1000 psig and a temperature level in the range of from about 400 degrees F. to about 700 degrees F. The coal liquefaction products were analysed and found to have the analyses set forth in Table I below.

TABLE I

| | |
|---|---|
| Specific Gravity 60/60 | 1.34 |
| Proximate Analysis | |
| % Loss at 105° C. | 0.4 |
| % Volatile Matter | 44.7 |
| % Fixed Carbon | 41.5 |
| % Ash | 13.4 |

The prepared feed mixtures then are utilized in various test runs to demonstrate the effectiveness of the present invention. The viscosity of the heavy phase for this feed mixture to form the dry, powdery composition was previously determined to be above about 1000 centipoise.

EXAMPLE

Two test runs are set forth to illustrate the present invention. In each, the pressure level in the apparatus of separation zone 12 is maintained at about 950 psig. The temperature level in the apparatus of separation zone 12 is maintained at about 500 degrees F. in the first run and at about 590 degrees F. in the second run. (FIG. 1)

In the first run, the viscosity is measured and found to be above the predetermined viscosity, therefore control valve SOV-1 is not actuated to place level valve LV-2 in operation. The heavy phase is withdrawn through conduits 16 and 18 to enter FD-1 wherein it is flashed and forms the dry, powdery composition.

In the second run, at a temperature level of 590 degrees F., the viscosity is measured and found to be below the predetermined viscosity. Viscosity transmitter VT-1 transmits a signal to control valve SOV-1 which transfers the flow of the heavy phase from conduit 18 to conduit 20 by closing level valve LV-1 in conduit 18 and opening level valve LV-2 in conduit 20. The heavy phase is introduced into FD-2 through conduit 20 and is flashed to form a semi-fluid.

While the present invention has been described in regard to using only a single separation zone, it is possible to employ the process and apparatus previously described in a system wherein a multiplicity of separation zones are connected to the flash drum separators.

Thus, while the present invention has been described with respect to what at present are considered to be the prefered embodiments thereof, it is to be understood that changes or modifications can be made in the process and apparatus without departing from the spirit or scope of the invention as defined in the following claims.

What is claimed is:

1. A continuous coal deashing process comprising:

introducing a feed mixture comprising soluble coal products, insoluble coal products and a solvent into a separation zone, said solvent consisting essentially of at least one subsubstance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

maintaining said separation zone at a temperature level in the range of from about 400 degrees F. to about 700 degrees F. and a pressure level in the range of from about 700 psig to about 1000 psig to effect a separation of said feed mixture into a light phase and a heavy phase within said separation zone;

providing a monitoring system to measure the viscosity of the heavy phase and compare the measured viscosity with a reference viscosity, said measurement being indicative of the physical characteristics of the heavy phase when withdrawn from the separation zone;

withdrawing the heavy phase from the separation zone; and transmitting a signal from the monitoring system to activate a selection means which directs the flow of said withdrawn heavy phase to a flash drum when said measured viscosity exceeds said reference viscosity and to an alternate process unit when said measured viscosity is below said reference viscosity.

2. The process of claim 1 in which the reference viscosity is about 1000 centipoise.

3. The process of claim 1 in which said alternate process unit is designed to handle semi-solid or fluid materials and is provided with an inner liner that is readily removable when filled with said heavy phase.

4. A continuous coal deashing process comprising:

introducing a feed mixture comprising soluble coal products, insoluble coal products and a solvent into a separation zone, said solvent consisting essentially of at least one subsubstance having a critical temperature below 800 degrees F. selected from the group consisting of aromatic hydrocarbons having a single benzene nucleus and normal boiling points below about 310 degrees F., cycloparaffin hydrocarbons having normal boiling points below about 310 degrees F., open chain mono-olefin hydrocarbons having normal boiling points below about 310 degrees F., open chain saturated hydrocarbons having normal boiling points below about 310 degrees F., mono-, di, and tri-open chain amines containing from about 2–8 carbon atoms, carbocyclic amines having a monocyclic structure containing from about 6–9 carbon atoms, heterocyclic amines containing from about 5–9 carbon atoms, and phenols containing from about 6–9 carbon atoms and their homologs;

maintaining said separation zone at a temperature level in the range of from about 400 degrees F. to about 700 degrees F. and a pressure level in the range of from about 700 psig to about 1000 psig to effect a separation of said feed mixture into a light phase and a heavy phase within said separation zone;

providing a monitoring system to measure the viscosity of the heavy phase and compare the measured viscosity with a reference viscosity of about 1000 centipoise, said measurement being indicative of the physical characteristics of the heavy phase when withdrawn from the separation zone;

withdrawing the heavy phase from the separation zone; and transmitting a signal from the monitoring system to activate a selection means which directs the flow of said withdrawn heavy phase to a flash drum when said measured viscosity exceeds said reference viscosity of about 1000 centipoise and to an alternate process unit when said measured viscosity is below said reference viscosity of about 1000 centipoise.

* * * * *